United States Patent [19]

Miller

[11] 4,437,667

[45] Mar. 20, 1984

[54] GEOMETRIC GAME

[76] Inventor: Ronald L. Miller, 7300 Cascade Rd., Grand Rapids, Mich. 49508

[21] Appl. No.: 366,607

[22] Filed: Apr. 8, 1982

[51] Int. Cl.[3] ..... A63F 9/08

[52] U.S. Cl. ..... 273/153 S; 273/241; 273/272; 434/172

[58] Field of Search ..... 273/153 S, 241, 272; 434/172

[56] References Cited

U.S. PATENT DOCUMENTS

| | | | |
|---|---|---|---|
| 2,380,106 | 7/1945 | Hilton | 273/272 X |
| 3,174,753 | 3/1965 | Miller | 273/157 R |
| 3,930,651 | 1/1976 | Rader | 273/272 X |
| 4,009,882 | 3/1977 | Rader | 273/272 X |
| 4,378,117 | 3/1983 | Rubik | 273/153 S |

FOREIGN PATENT DOCUMENTS

| | | | |
|---|---|---|---|
| 55-3956 | 1/1980 | Japan | 273/153 S |
| 2071505 | 9/1981 | United Kingdom | 273/272 |

*Primary Examiner*—Anton O. Oechsle

*Attorney, Agent, or Firm*—Price, Heneveld, Huizenga & Cooper

[57] ABSTRACT

A geometric game which includes markers and a playing unit. The playing unit has a multi-faced geometric configuration, such as a cube, with each face having a number of facets corresponding to facets on the other faces. The markers each carry one of a variety of indicia, such as letters of the alphabet, and have an adhesive surface opposite the side carrying the indicia. Markers carrying the indicia desired are chosen and removably adhered to each facet of the playing unit to provide a starting configuration. The playing unit contains an internal mechanism which allows any group of facets lying in a single plane to be pivoted about the perimeter of the playing unit to shift the group of facets from one face to another, thereby disorganizing the marker configuration. The internal mechanism must be operated to return the markers to the starting configuration. The markers are then removed for commencement of another game. Further, a playing unit is used with a random chance means and timekeeping means, the playing unit having markers affixed to it carrying letters of the alphabet. The game is played by multiple players, with the amount of time allotted each player to spell the maximum number of words on the faces of the playing unit determined by the chance means and measured by the timekeeping means. A second playing unit may be placed in abutment with the first playing unit to produce faces containing twice as many indicia as on a single face.

11 Claims, 4 Drawing Figures

GEOMETRIC GAME

BACKGROUND OF THE INVENTION

The field of games and puzzles have enjoyed increased interest of late with the advent of adult and educational games. Such games not only provide relaxation and entertainment for the players, but also provide mental stimulation and develop reasoning processes as well as other faculties. Certain puzzles requiring physical manipulation are often used by individuals when concerned with a particular problem, and serve to occupy their hands and focus their thought processes. Games which require physical manipulation also help to relieve excess energy and tension produced by stressful situations.

One game of the type requiring physical manipulation provides a cubic structure having a number of squares on each individual face of the cube. The cube has an internal mechanism which allows any bank or set of squares lying in a single plane to be pivoted about a central axis in order to shift the squares of one face to another. Originally, each cube face has a different uniform color which allows for identification of the individual squares. The object of this game is to return all the similar colored squares to a single face after their locations have become disorganized. One such game is marketed under the trademark RUBIK's CUBE, owned by the Ideal Toy Corporation. Heretofore, such games have provided geometric configurations in which each face is distinguished by a different color, these color indicia being permanently connected.

SUMMARY OF THE INVENTION

The invention of the present application provides a game which includes markers and a playing unit made up of a number of shiftable facets. Each marker carries a design and are to be attached to the different facets of the playing unit.

In a more specific embodiment, the markers each carry a letter of the alphabet and can be adhesively attached to the playing unit to spell words as desired by the player. After the location of the letters have been shifted on the playing unit, the player must return all the letters to their original position in order to spell out the original words. The letters can be removed and recombined as desired.

In a second embodiment, a playing unit having markers attached to it carrying letters of the alphabet as indicia is used with a random chance means, such as a spinner or die, and a timekeeping means. The chance means is used to determine how much time a player is allowed in which to spell words simultaneously on the faces of the playing unit, with a predetermined number of points awarded for each number of words so spelled. This game provides competition between numerous players as well as providing an individual challenge for each individual player.

In still another embodiment a second playing unti is provided for use with a first playing unit, chance means and timekeeping means. Two teammates each operate one of the playing units as described in the second embodiment above, with the cubes being scored individually, or placed in abutment with each other to provide certain faces having twice the number of letters in a row as contained on a single unit. When placed in abutment the cubes are scored together.

The game of the present invention provides both relaxation and entertainment, and also operates as a tension release by occupying a user's hands. Additionally, the game has educational value in developing spelling, logic and mathematical relationship skills.

If non-uniform letters are used as indicia, the game of the present invention is more difficult than cubic games which make use of uniformly colored squares on each face of the cube. As the particular orientation of each square is unimportant in such a color-coded game and each face is uniform, more than one ultimate solution or configuration is possible. In the game of the present invention which makes use of letters or other indicia, not only can the game be set up so that none of the indicia are interchangeable, but each indicia must be oriented correctly. With such a starting configuration of indicia there is only a single solution to the game.

The game has particular usefulness and applicability in teaching the learning impaired and in medical rehabilitative therapy. Since the letters can be selected and removably attached to the cube as desired, the degree of difficulty of the game can be reduced to allow a progression of the reasoning faculties necessary to solve the game. This can be accomplished by making a number of the faces of the game all contain the same letter, or cause all the facets which lie in a particular row or column of the faces to be identical, reducing the number of facets requiring repositioning, and thus reducing the variables and difficulty of the game. Also, if the game proves to be too difficult in a selected configuration and a player desires to start over, the markers can be removed and set up in a new starting configuration.

DETAILED DESCRIPTION OF THE PREFERRED EMBODIMENT

Figure 4:
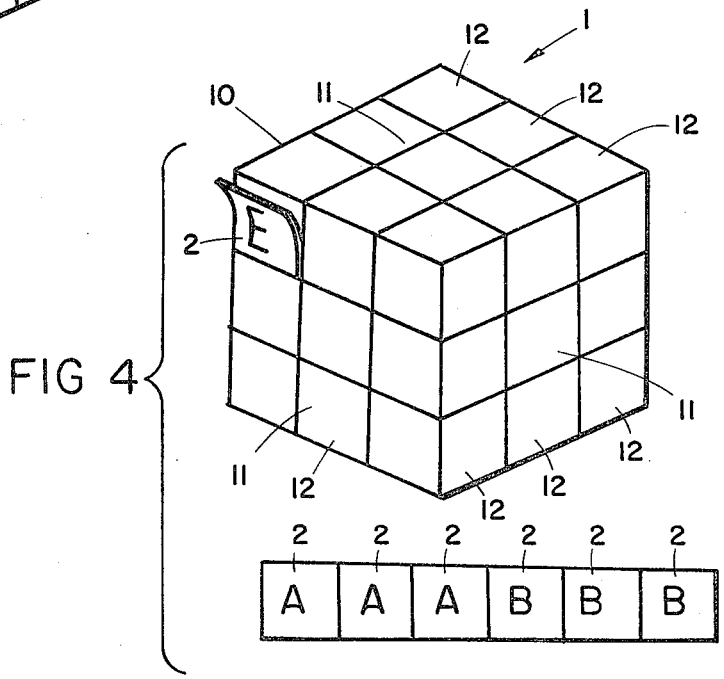
FIG. 4 is a side perspective view of a cube and markers of the present invention.

As shown in FIG. 4, the present invention provides a game which includes a playing unit 1 having a multifaced geometric configuration in which all the faces are uniform in appearance. Numerous stickers or markers 2 are provided, each of which carries some indicia, there being at least as many different indicia as there are faces on the playing unit 1. The markers 2 are removably attached by the player to the playing unit 1, which has a mechanism which allows facets on each face of the unit to be shifted in order to disorganize the markers. The player then is required to return the markers to their original configuration.

In the preferred embodiment, the playing unit 1 has a cubic configuration 10 with six faces 11. Each face 11 includes nine facets 12 which are squares of equal size layed out in three rows and three columns.

Figure 1:
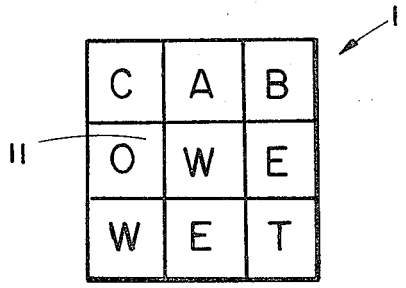
FIG. 1 is a side elevational view of a cube with letters attached embodying the present invention.
Figure 2:
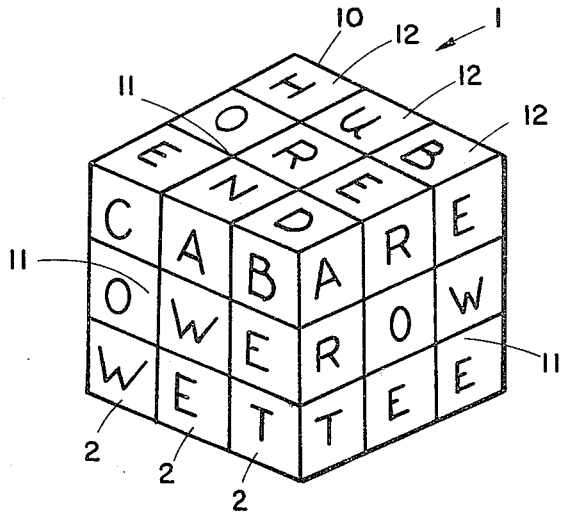
FIG. 2 is a perspective view of a cube with letters attached of the present invention.
Figure 3:
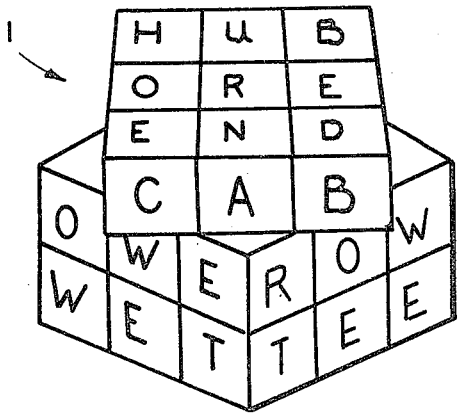
FIG. 3 is a perspective view of the cube of FIG. 2 in operation.

The playing unit contains an internal mechanism, which is well known in the art, that maintains the playing unit as a single element, but also allows any row or column of any face to be pivoted around the perimeter of the cube on a line parallel to that row or column of facets 12, shown in FIG. 3. The internal mechanism thereby shifts any given row or column of facets 12 onto a different face of the cube while shifting corresponding rows or columns of facets on other faces, as shown in FIG. 3. The particular location of any given row or column can be shifted to being a corresponding location. One such mechanism is marketed under the trademark "RUBIK'S CUBE" by Ideal Toy Corporation.

Markers 2 are square labels, each of which carries some indicia, preferrably a letter of the alphabet. A large number of letters are provided, preferably with numerous repetitions of each letter of the alphabet. On the face or side of each marker 2 opposite to the side carrying the letter is a pressure sensitive adhesive substance which can be used to repeatedly adhere and remove markers 2 from playing unit 1.

During play, a player selects markers 2 which carry the letters the player desires to use and affixes one of such markers 2 to each of the facets 12 on the playing unit 10. Preferably, the letters are organized on the facets 12 of playing unit 1 to spell out words in each column and row. After the letters have been affixed to provide a starting position, the playing unit 10 is randomly twisted in order to shift the various facets 12 and markers 2 to new positions and thereby disorganize the words spelled by the letters on markers 2. After the playing unit and markers have been sufficiently disorganized, the player attempts to return the markers to their original starting position to spell out the selected words by operating the twisting mechanism within the playing unit 10.

When the game has been completed by returning the letters to their starting position, the playing unit can then be used again, or the markers 2 removed from the playng unit 10 to be set up in a new starting configuration. If a particular player has devoted sufficient time to the game, yet has not yet succeeded in returning the markers to their starting position and other players desire to use the game, the markers can be peeled off or removed from the playing unit 10 and be reaffixed in a desired new starting position.

The degree of difficulty of the game can be reduced by the arrangement of letters on the various faces 11. If all of the letters in a given column or row on corresponding faces are made identical, the number of variables in the game are reduced. Also the difficulty of the game can be reduced by making all of the facets on several faces of the game identical, which also reduces the variables in the game. As more of the different facets are made interchangeable, the difficulty of the game is reduced.

The ability to vary the difficulty of the game is one attribute which makes the game desirable for medical therapy and other teaching situations. Two letter words can be employed on the faces of the playing unit and one row and column left uniform, with the uniform rows and columns being located in corresponding positions on the faces. This allows for a number of markers to be interchangeable. The difficulty can be even further reduced by placing only one or two non-uniform indicia on each face, and further reducing the variables involved with the game.

In a second embodiment a game is provided which can be played by multiple players. A playing unit 1 has markers 2 attached to it, the markers carrying letters of the alphabet as indicia, with the letters having a starting configuration spelling out words. A random chance means, such as a spinner or die (not shown), is operated by a player to determine the amount of time he is allotted to spell out as many words as possible on the faces of the cube simultaneously. Each of the six numbers on the chance means, if a die is used, is assigned a predetermined amount of time. For example, a roll of 1 is assigned a time of forty-five seconds. The timekeeping means (not shown), such as a watch with a second hand, is used to time the player as he attempts to spell words with the letters on the playing unit. At the end of the player's allotted time a predetermined number of points are awarded the player according to the total number of words spelled out by the final configuration of the playing unit, with a greater number of points awarded for a larger number of words. Penalty points can be deducted for a word that was produced during the course of a player's turn but do not appear on the playing unit at the end of the turn of that player. Bonus points can be awarded for multiple words on a single face or for completion of all the words on one face.

The next player then operates the chance means and proceeds with his turn. This game therefore, provides competition between multiple players as well as providing entertainment for an individual player.

In still another embodiment two playing units are used, with the players being grouped into teams of two players each. The game is played according to the second embodiment described above, with the exception that both members of a team each operate one of the two playing units simultaneously. At the end of the allotted time period points can be awarded for each individual playing unit, or the two playing units can be placed in abutment with each other to provide some rows with 6 indicia contained therein. Points are then awarded the two playing units in combination.

It is to be understood that the above description and drawings are of the preferred embodiment and various changes or modifications can be made without departing from the spirit of the invention embodied therein, such as the use of indicia different from letters of the alphabet on the removable markers, or the use of a playing unit having a different geometric configuration. Therefore, it will be understood that the embodiments shown in the drawings and above description are not intended to limit the scope of the invention defined by the claims which follow.

The embodiment of the invention in which an exclusive property or privilege is claimed are defined as follows:

1. A game comprising:

a playing unit having a multi-faced geometric configuration, each face of said playing unit having a plurality of affixing facets, all of said faces having an identical number and arrangement of said facets, said playing unit having twisting means for maintaining said facets in a single unit and allowing any linear combination of said facets on any one of said faces to be twisted so as to be disposed on a different face and simultaneously changing the location of corresponding facets on corresponding faces;

a plurality of markers, each marker carrying one of a plurality of indicia, at least some of said indicia being orientatable, said plurality of indicia having more distinguishable indicia than the number of said faces of said playing unit;

affixing means for repeatedly removably affixing each of said individual markers to each of said facets, said markers being selected and affixed by a player to said facets of said playing unit to provide a recognizable pattern of indicia as a desired starting configuration, the playing unit being twisted by the player with said markers affixed thereto to disorganize said player selected configuration of said markers while said markers remain affixed to said unit, said playing unit being twisted by the player to return said markers to the player selected starting configuration;

whereby said markers can be affixed to said facets in any desired combination by a player and be removed from said playing unit when said player selected starting configuration is reproduced or to commence a new pattern of play prior to termination of the previous pattern of play, and reaffixed to said facets in a different combination.

2. A game as described in claim 1 wherein said indicia carried by said markers are letters of the alphabet whereby said indicia provides words when said markers are affixed to said playing unit.

3. A game as described in claim 1 or 2 wherein said playing unit has a cube configuration and each face of said playing unit has nine facets.

4. A method of using the game described in claim 1, comprising:

attaching one of said markers to each of said facets to provide a desired player selected starting configuration;

shifting the location of said facets by operation of said twisting means;

shifting the location of said facets to return said facets to said player selected starting configuration by operation of said twisting means.

5. A method of use of a game as described in claim 4, wherein the indicia carried by the markers provided are letters of the alphabet.

6. Method of use of a game as described in claim 4 or 5, wherein said markers are attached to said playing unit to provide a starting configuration in which all of said facets of more than one side of said playing unit have markers carrying the identical indicia.

7. A game as described in claim 1 or 2 in which said facets have said markers affixed thereto, at least one linear combination of said facets on more than one face of said playing unit have affixed thereto markers of uniform indicia, said linear combination being disposed on one of said faces in a location corresponding to the other linear combination on at least another of said faces, whereby the number of different indicia affixed to said playing unit is reduced.

8. A game comprising:

a playing unit having a multi-faced geometric configuration, each face of said playing unit having a plurality of affixing facets, all of said faces having an identical number and arrangement of said facets, said playing unit having twisting means for maintaining said facets in a single unit and allowing any linear combination of said facets on any one of said faces to be twisted so as to be disposed on a different face and simultaneously changing the location of corresponding facets on corresponding faces;

a plurality of markers, each marker carrying one of a plurality of indicia, each of said indicia being one of the leters of the alphabet, one of said markers being selectively, repeatedly removably affixed to each of said facets of said playing unit to provide a pattern of words spelled by said letters as a player selected desired starting configuration, and to be carried on said facets as said playing unit is twisted to different configurations during play;

a random chance means for randomly determining a time period;

a timekeeping means for determining the elapse of time;

whereby when the playing unit has been twisted to disorganize said starting configuration, the random chance means is used to determine a time period allotted to a player to spell the maximum number of words on said faces at the expiration of said time period allotted by the twisting of said playing unit by the player, said time period expiration being determined by said timkeeping means.

9. A game as described in claim 8 wherein said markers have an affixing means for affixing said markers to said playing unit after said markers have been removed from said playing unit.

10. A game as described in claim 9 wherein said playing unit has a cube configuration and each face of said playing unit has nine facets.

11. A game as described in claim 8, 9 or 10 further comprising:

a second playing unit having a multi-faced geometric configuration, each face of said second playing unit having a plurality of affixing facets, all of said faces having an identical number and arrangement of said facets, said second playing unit having twisting means for maintaining said facets in a single unit and allowing any linear combination of said facets on any one of said faces to be twisted so as to be disposed on a different face and simultaneously changing the location of corresponding facets on corresponding faces;

whereby said playing units can be placed in abutment to provide certain faces having twice as many markers as a single playing unit face.

* * * * *